US006603251B1

(12) United States Patent
Ko

(10) Patent No.: US 6,603,251 B1
(45) Date of Patent: Aug. 5, 2003

(54) SHADOW MASK FOR FLAT CATHODE RAY TUBE

(75) Inventor: Sung-Woo Ko, Kumi (KR)

(73) Assignee: LG Electronics, Inc., Seoul (KR)

( * ) Notice: Subject to any disclaimer, the term of this patent is extended or adjusted under 35 U.S.C. 154(b) by 577 days.

(21) Appl. No.: 09/109,403

(22) Filed: Jul. 2, 1998

(30) Foreign Application Priority Data

Jul. 3, 1997 (KR) ..... 1997-30730

(51) Int. Cl.[7] ..... H01J 29/80
(52) U.S. Cl. ..... 313/402; 313/403
(58) Field of Search ..... 313/402, 403, 313/404, 407, 269

(56) References Cited

FOREIGN PATENT DOCUMENTS

| | | |
|---|---|---|
| JP | 6 139948 A | 5/1991 |
| JP | 6139948 A | 5/1994 |
| KR | 94 11640 B | 12/1994 |
| KR | 9411640 | 12/1994 |

*Primary Examiner*—Vip Patel
(74) *Attorney, Agent, or Firm*—Birch, Stewart, Kolasch & Birch, LLP

(57) ABSTRACT

A shadow mask for a flat cathode ray tube having a plurality of pores for discriminating electron beams emitted from electron guns by colors, and a vibration attenuation device disposed in a space between the pores, the shadow mask being provided with at least one reference portion for indicating the position at which the vibration attenuating device is to be installed. By referring to the reference portion, the vibration attenuating device can be accurately positioned in a space between the pores of a shadow mask without blocking the pores.

14 Claims, 5 Drawing Sheets

SHADOW MASK FOR FLAT CATHODE RAY TUBE

BACKGROUND OF THE INVENTION

1. Field of the Invention

The present invention relates to a shadow mask for a flat cathode ray tube and, more particularly, to determining the proper installation position of a damper wire for mitigating vibrations of a shadow mask.

2. Discussion of Related Art

A typical flat cathode ray tube, as shown in FIG. 1, includes: a panel 1 whose internal surface is coated with R, G and B fluorescent coatings; an anti-explosion glass 2 fixed to the front surface of the panel 1 with a resin; a funnel 3 adhesively melted to the rear end of the panel 1 and held in a vacuum inside of the cathode ray tube; electron guns 5 embedded in the neck 4 of the funnel 3 with a seal; a shadow mask 7 having a plurality of pores 6 through which the electron beams emitted from the electron guns 5 pass and the electron beams are discriminated in colors; and a rail 8 for supporting the shadow mask and separating the panel 1 and the shadow mask 7 from each other at a fixed distance.

When power is applied to such a conventional flat cathode ray tube as constructed above, electron beams are emitted from the electron guns 5, discriminated in colors while they are passing through the shadow mask 7, striking the fluorescent coatings to create a picture.

The electron beams that pass through the pores of the shadow mask 7 are no more than about 20% with respect to the total electron beams emitted from the electron guns 5, and the rest of the electron beams strike the shadow mask 7 to generate heat energy which expands the shadow mask 7. This thermal expansion of the shadow mask 7 is referred to as a "doming effect".

The doming effect changes the positions at which the electron beams land on the fluorescent coatings, thereby deteriorating the purity of colors. In order to settle this problem, use is made of an invar mask less susceptible to thermal expansion for the shadow mask 7, or a bimetal spring for fixing the shadow mask 7 to the panel 1. However, such methods of suppressing the doming effect result in higher production cost and a deterioration of production efficiency.

Accordingly, a flat foil tension mask has been recently used to prevent a thermal expansion of the shadow mask 7 caused by the electron beams in a such manner that the shadow mask 7 has a stress to cause a compulsory elongation, and this mechanical deformation countervails against the thermal expansion of the shadow mask 7 resulting from striking electron beams.

Although such a shadow mask 7 is advantageous in prevention of the doming effect, the shadow mask 7 is no more than about 20 to 30 $\mu$m in thickness and is thus susceptible to vibrations from insignificant shocks. And worse, there occurs a howling effect by which the vibrations of speakers shakes the shadow mask in operation of the cathode ray tube because the shadow mask 7 is soldered to the four sides of the rail 8 and the vibrational energy is easily transferred. The howling effect is a phenomenon that an external vibration such as caused by the sound pressure of speakers is iteratively transferred to the panel, spring, rail and shadow mask in sequence and thereby a resonance occurs to increase the amplitude of vibration of the shadow mask when the external vibration corresponds to the natural frequency of the shadow mask.

During the operation of the cathode ray tube in case of the howling effect, electron beams emitted from the electron guns 5 pass through the pores 6 of the shadow mask 7 but, when the shadow mask 7 vibrates, the electron beams strike the incorrect pixels. This is what is called a "mislanding effect".

In order to avoid such vibrations of the shadow mask 7, a damper wire 9 with a tension is installed in a transverse direction of the shadow mask 7, as illustrated in FIG. 2. However, the damper wire 9 causes the pores 6 of the shadow mask 7 to be blocked and the corresponding fluorescent materials hardly emit lights, so that there remains a mark of the damper wire 9 on the screen, deteriorating the quality of picture.

According to the present invention, as shown in FIG. 3, a damper wire for supporting the shadow mask is disposed in a space between the pores 6 of the shadow mask 7 in order to prevent the pores 6 from being blocked by the damper wire 9, thereby maintaining a good quality picture and reducing the vibration of the shadow mask 7.

It is very important in this case to position the damper wire 9 accurately in a narrow space between the pores 6 of the shadow mask 7. Otherwise, the shadow of the damper wire 9 is thrown on the screen.

Therefore, a proper and acceptable reference position must be determined on the shadow mask so as to install the damper wire at the right position. Customarily, the reference position is determined with the naked eye and the damper wire is installed in a pore already formed on the shadow mask. However, it takes too much time and effort in positioning the damper wire accurately and causes an increase product defects.

SUMMARY OF THE INVENTION

Accordingly, an object of the present invention is to position a damper wire accurately in a space between the pores of a shadow mask without blocking the pores with the damper wire.

In accordance with an aspect of the present invention, a shadow mask for a flat cathode ray tube has a plurality of pores for discriminating electron beams emitted from electron guns by colors, and a vibration attenuation device disposed in a space between the pores. The shadow mask is provided with at least one reference portion for determining the position at which the vibration attenuating device is to be installed.

Other features and advantages of the present invention will be apparent from the following description taken in conjunction with the accompanying drawings.

BRIEF DESCRIPTION OF THE ATTACHED DRAWINGS

DETAILED DESCRIPTION OF PREFERRED EMBODIMENT

Hereinafter, the preferred embodiments of the present invention will be described with reference to the accompanying drawings.

Figure 1:
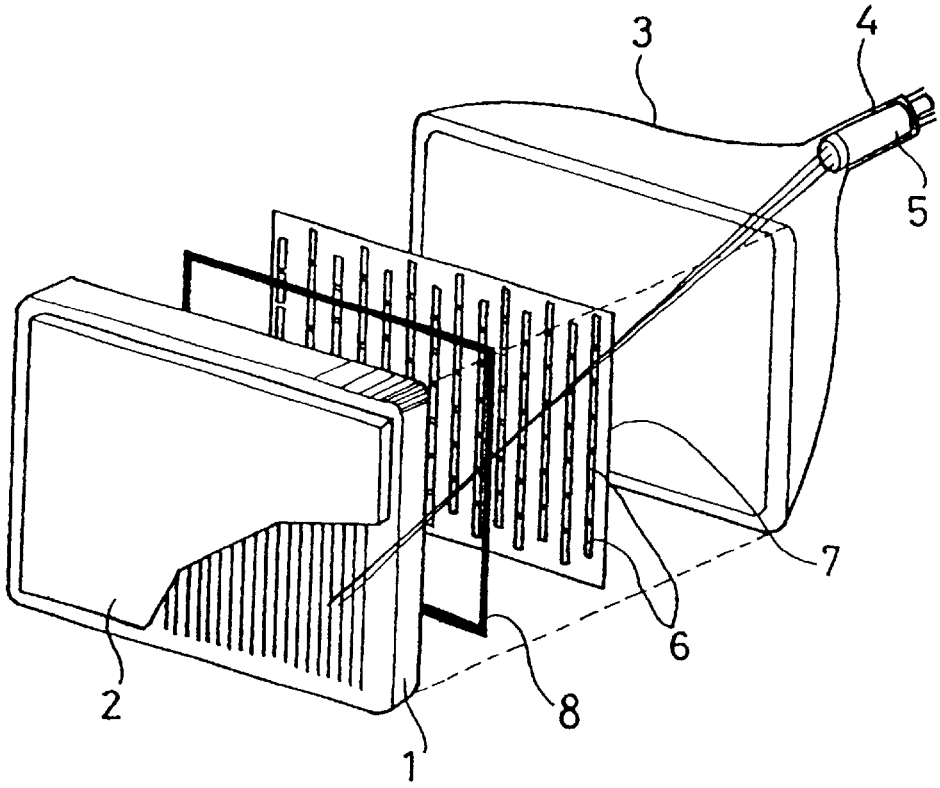
FIG. 1 PRIOR ART
FIG. 1 is a conventional view illustrating the construction of a general flat cathode ray tube.
Figure 2:
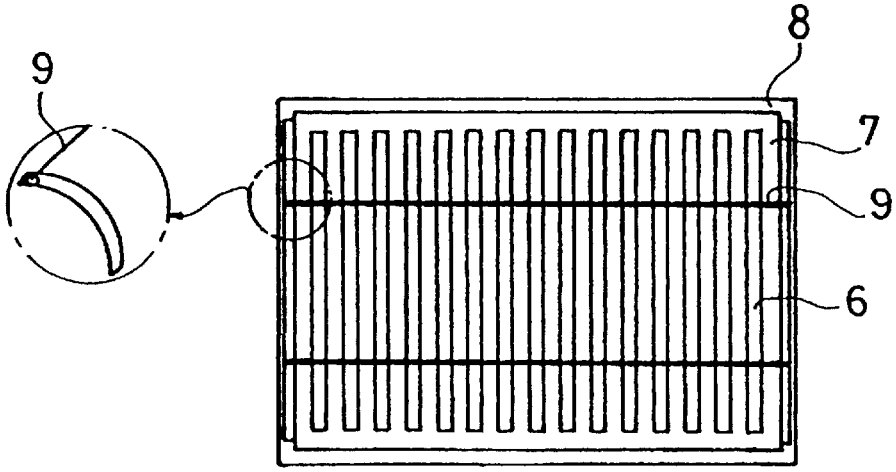
FIG. 2 PRIOR ART
FIG. 2 is a conventional view illustrating a structure for attenuating the vibration of a shadow mask in a conventional flat cathode ray tube.
Figure 3:
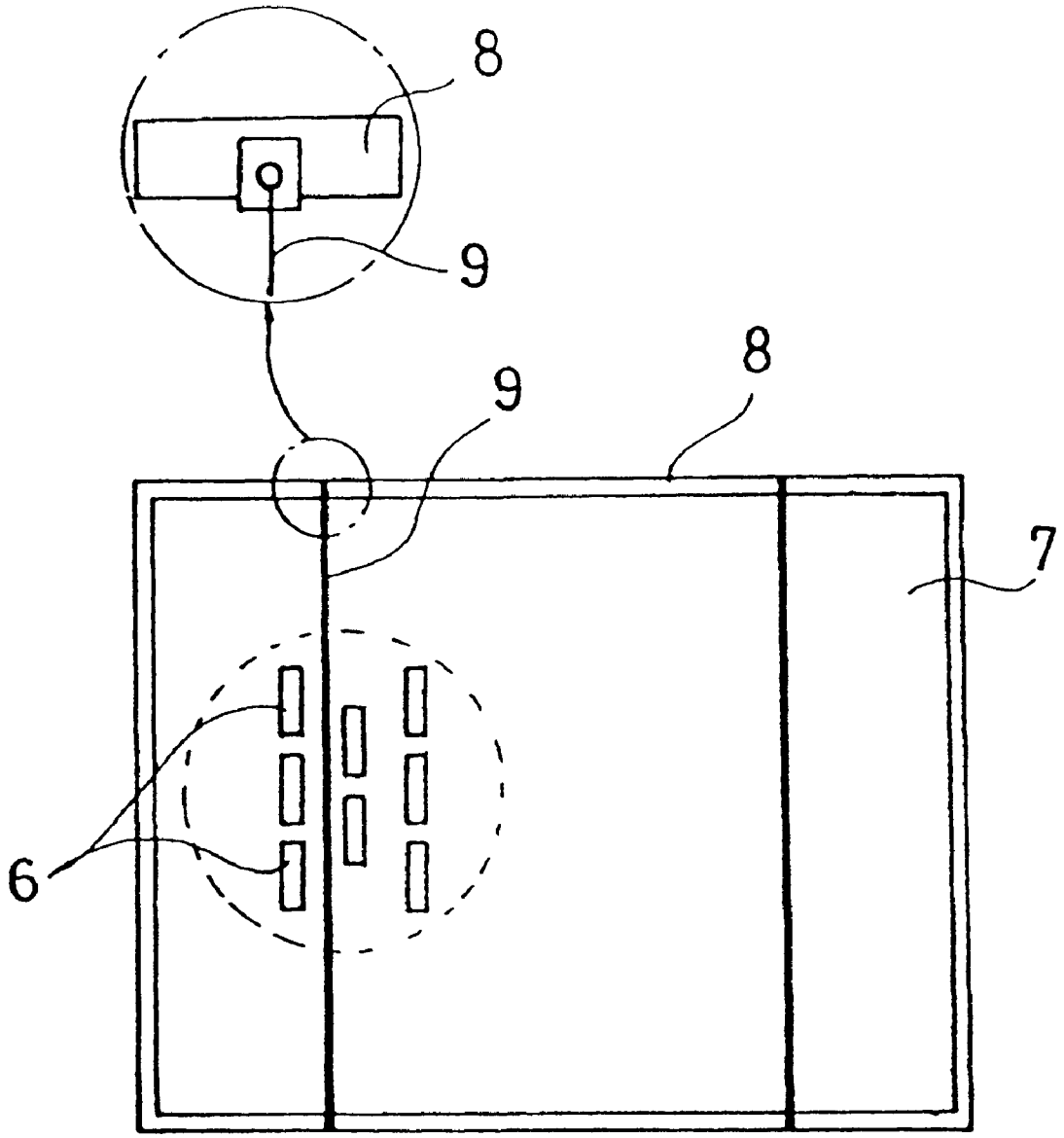
FIG. 3 PRIOR ART
FIG. 3 is a view of a second preferred embodiment of the present invention illustrating a structure for attenuating the vibration of a shadow mask in a conventional flat cathode ray tube.
Figure 4:
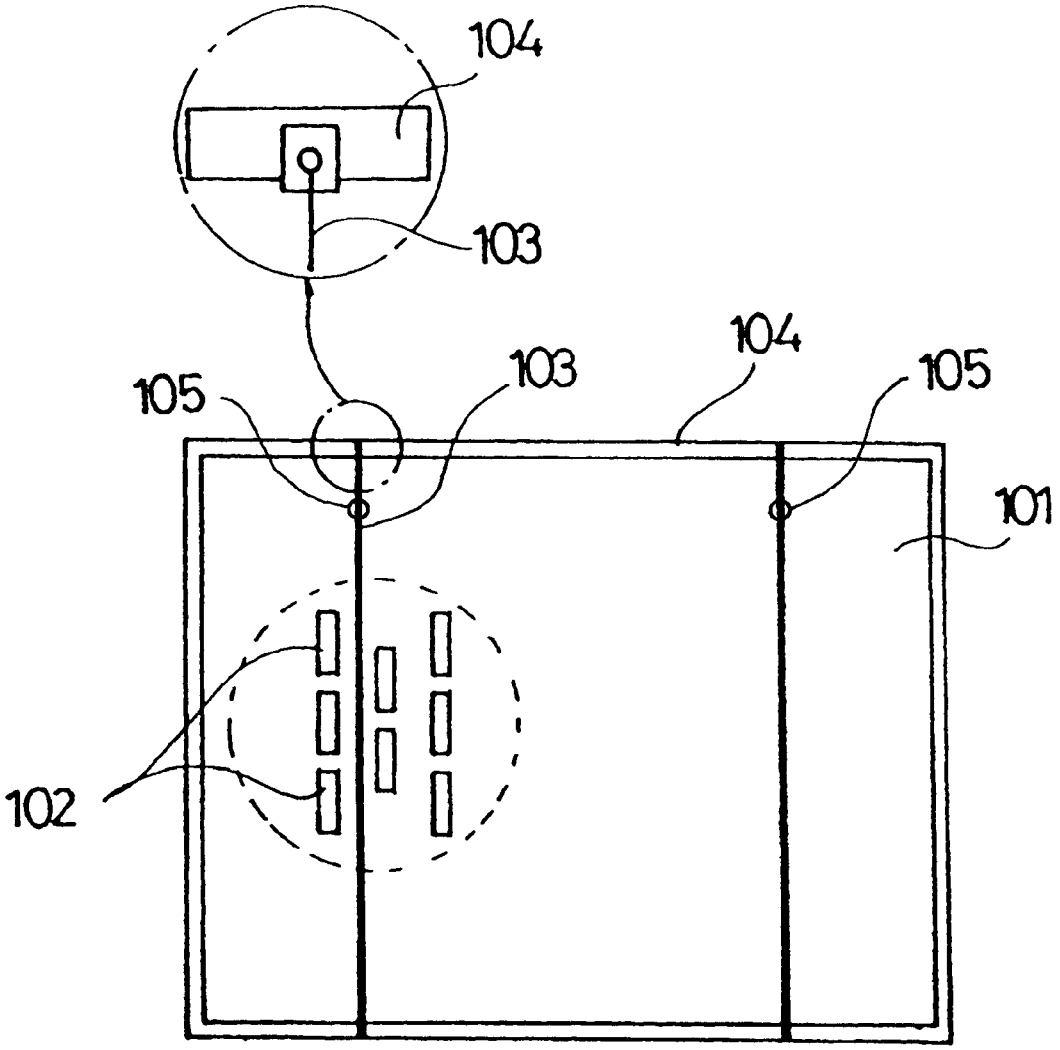
FIG. 4 is a view illustrating the construction of a shadow mask for a flat cathode ray tube in accordance with the present invention.
Figure 5A:
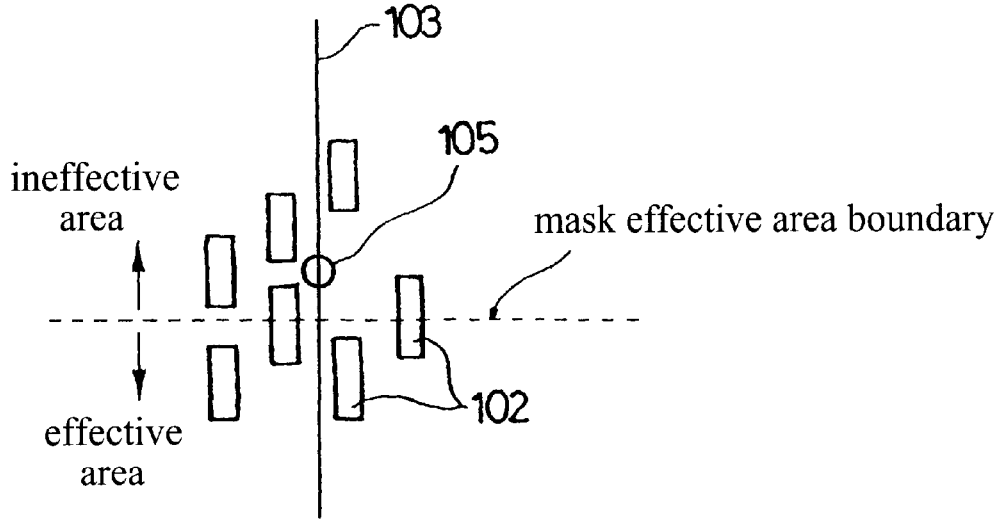
FIGS. 5*a* through 5*d* are detailed views illustrating a positioning hole of a shadow mask for a flat cathode ray tube in accordance with the present invention.
Figure 5B:
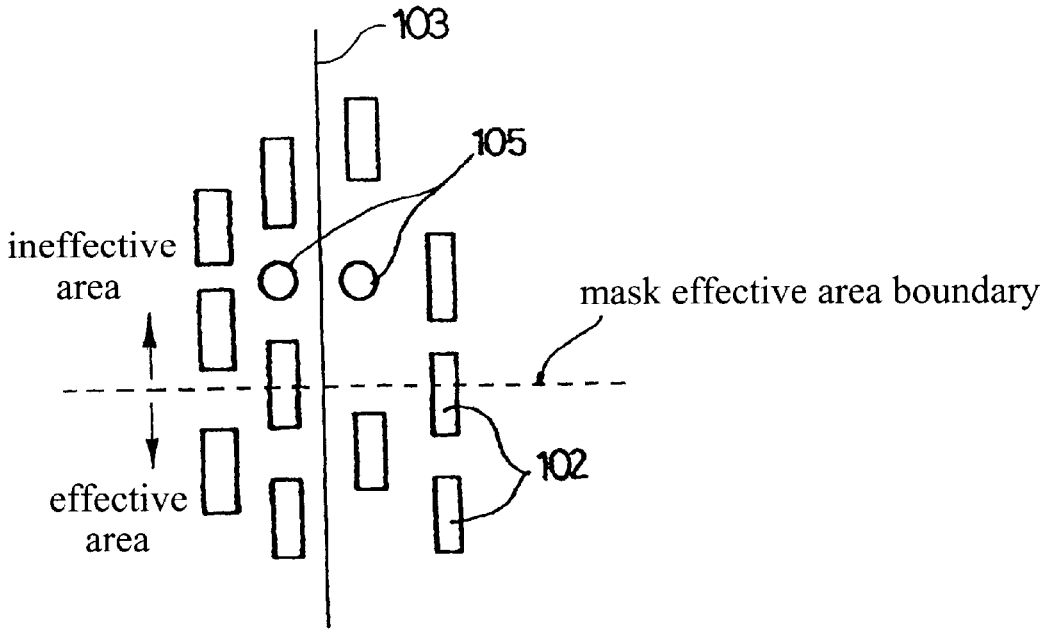
Figure 5C:
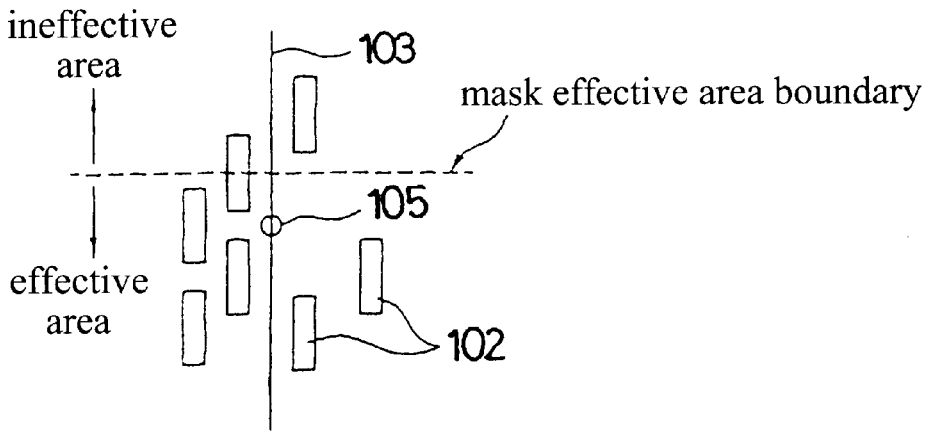
Figure 5D:
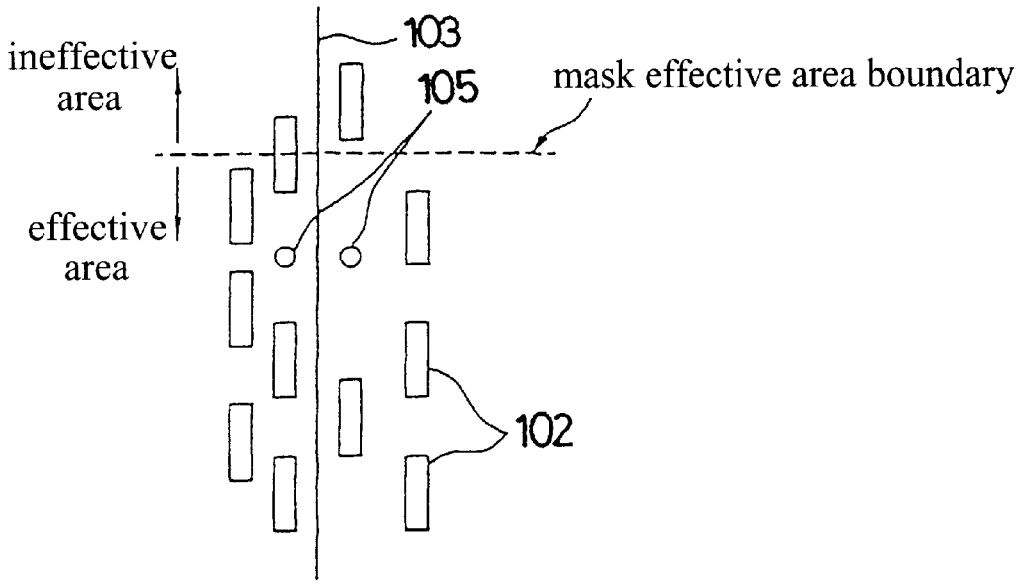

FIG. 4 illustrates the construction of a shadow mask for a flat cathode ray tube in accordance with the present invention.

Referring to FIG. 4, a plurality of slot-shaped pores 102 are formed in a shadow mask 101 which has a function for discriminating the electron beams in colors. At least one damper wire 103 is closely installed in a space between the pores 102 on the surface of the shadow mask 101 in order to attenuate the vibration of the shadow mask 101 due to striking electron beams or an external shock, both ends of the damper wire 103 being soldered to the sides of a rail 104 supporting the shadow mask 101.

Furthermore, a hole 105 which is a reference position for determining the position of the damper wire 103 is formed in the effective area of the shadow mask 101 or in its adjacent outer portion (non-effective area). The hole 105 is usually formed in the non-effective area of the shadow mask 101 but may be formed in the effective area of the shadow mask 101, as long as the damper wire 103 installed does not interfere with any pore 102.

That is, the hole 105 for positioning the damper wire 103 can be formed in the center of the effective area of the shadow mask 101 for convenience in working.

The operation of the present invention as constructed above will be described below in detail with reference to the attached figures.

First, it is most important to avoid the shadow of the damper wire 103 thrown on the screen in positioning the damper wire 103 in a space between the pores 102 of the shadow mask, in order to attenuate the vibrations of the shadow mask 101 caused by striking electron beams or sound pressure of speakers.

For this reason, the present invention is provided with a hole 105 which is a reference position for installing the damper wire 103 in order to position the damper wire 103 accurately in a space between the pores 102 of the shadow mask 101 in a perpendicular direction.

For a general CDT (for a monitor) in which a horizontal pitch between the pores 102 of the shadow mask 101 is around 240 $\mu$m, the distance between the pores 102 is approximately 180 $\mu$m and the diameter of the damper wire 103 is preferably in the range 30 to 80 $\mu$m. As for a general CPT (for domestic use), it is preferable that the damper wire 103 is 100 to 300 $\mu$m in diameter since the horizontal pitch between the pores 102 is about 500 to 670 $\mu$m.

Furthermore, the damper wire 103 is made of a material which differs in physical properties from that of the shadow mask 101 in order to enhance an effect for preventing vibration of the shadow mask 101 caused by an external shock due to different vibrational characteristics.

FIGS. 5*a*–5*d* are detailed views illustrating a positioning hole of a shadow mask in a flat cathode ray tube in accordance with the present invention.

Referring to FIGS. 5*a*–5*d* the shadow mask 101 is provided with one or two holes 105 which represent reference positions at which the damper wire 103 is installed. If only one hole is formed on the shadow mask 101, the hole 105 is disposed at a position between the two adjacent pores 102 of the shadow mask such that the damper wire 103 is positioned within the area on the hole 105. If two holes are formed, the holes 105 are located at the two adjacent pores 102 of the shadow mask 101 so as to position the damper wire 103 accurately in a space between the two holes 105 through which the electron beams pass. There is no particular limitation upon the number of holes 105, and more than two holes 105 can be formed on the shadow mask 101.

Although the holes 105 are arranged in a perpendicular direction with respect to the shadow mask 101 in the above exemplary embodiment, there is no particular limitation upon the direction in which the holes 105 are arranged, and the holes 105 can be formed in a horizontal, diagonal or any direction with respect to the shadow mask 101, insofar as they do not interfere with the pores 102 of the shadow mask 101.

Furthermore, the holes 105 are different in shape and size from the pores 102 of the shadow mask 101 for promoting the ease of operation and reducing a defect rate.

Below is given a description of a process for installing the damper wire in the shadow mask by use of a reference hole according to the present invention.

First, a CCD (Charge Coupled Device) camera in the CMA (Coated Mask Assembly) is used to identify the reference hole 105 formed on the shadow mask 101.

The position of the hole 105 is found out from a view of the monitor displayed through the CCD camera while moving the damper wire 103 in the vicinity of the hole 105. With the damper wire 103 closely fixed to the reference hole 105, the both ends of the damper are soldered to the sides of the rail 104.

This process can be performed in an automatic system as well as a manual system with the naked eye.

Furthermore, the present invention is not specifically limited to fixing the damper wire 103 in a perpendicular direction with respect to the shadow mask 101, and the damper wire 103 can be fixed in any direction with respect to the shadow mask 101 as long as it suppresses a vibration of the shadow mask 101 without blocking the pore 102 of the shadow mask 101.

Such as in the present invention as described above, a proper and acceptable positioning hole for determining the position of the damper wire is formed in the non-effective area of the shadow mask in order to position the damper wire in a space between the pores of the shadow mask, thereby avoiding a vibration of the shadow mask and preventing the shadow of the damper wire from being cast onto the screen with a consequence of enhancement of picture quality. Furthermore, it becomes easier to install the damper wire on the shadow mask, enhancing productivity and reducing a defect rate.

What is claimed is:

1. A shadow mask for a flat cathode ray tube, which has a plurality of pores for discriminating electron beams emitted from electron guns by colors, and a vibration attenuation device disposed in a space between the pores, the shadow mask being provided with at least one reference portion for determining the position at which the vibration attenuation device is installed, wherein the reference portion differs in shape or size from the pores of the shadow mask.

2. A shadow mask for a flat cathode ray tube, which has a plurality of pores for discriminating electron beams emitted from electron guns by colors, and a vibration attenuation device disposed in a space between the pores, the shadow mask being provided with at least one reference portion for determining the position at which the vibration attenuation device is installed, wherein the reference portions are formed in a non-effective area of the shadow mask.

3. A shadow mask for a flat cathode ray tube, which has a plurality of pores for discriminating electron beams emitted from electron guns by colors, and a vibration attenuation device disposed in a space between the pores, the shadow mask being provided with at least one reference portion for determining the position at which the vibration attenuation device is installed, wherein the reference portions are formed in an effective area of the shadow mask.

4. A shadow mask for a flat cathode ray tube, which has a plurality of pores for discriminating electron beams emitted from electron guns by colors, and a vibration attenuation device disposed in a space between the pores, the shadow mask being provided with at least one reference portion for determining the position at which the vibration attenuation device is installed, wherein the reference portions are arranged in a perpendicular direction with respect to the shadow mask.

5. A shadow mask for a flat cathode ray tube, which has a plurality of pores for discriminating electron beams emitted from electron guns by colors, and a vibration attenuation device disposed in a space between the pores, the shadow mask being provided with at least one reference portion for determining the position at which the vibration attenuation device is installed, wherein the reference portions are arranged in a horizontal direction with respect to the shadow mask.

6. A shadow mask for a flat cathode ray tube, which has a plurality of pores for discriminating electron beams emitted from electron guns by colors, and a vibration attenuation device disposed in a space between the pores, the shadow mask being provided with at least one reference portion for determining the position at which the vibration attenuation device is installed, wherein the reference portions are arranged in a diagonal direction with respect to the shadow mask.

7. A shadow mask for a flat cathode ray tube, which has a plurality of pores for discriminating electron beams emitted from electron guns by colors, and a vibration attenuation device disposed in a space between the pores, the shadow mask being provided with at least one reference portion for determining the position at which the vibration attenuation device is installed, wherein the pores of the shadow mask are slots.

8. A shadow mask for a flat cathode ray tube, which has a plurality of pores for discriminating electron beams emitted from electron guns by colors, and a vibration attenuation device disposed in a space between the pores, the shadow mask being provided with at least one reference portion for determining the position at which the vibration attenuation device is installed, wherein the pores of the shadow mask are holes.

9. A cathode ray tube shadow mask assembly, comprising:

a shadow mask having a plurality of pores for passing electron beams therethrough;

a vibration attenuator for minimizing vibrations of the shadow mask; and wherein the shadow mask further includes at least one reference portion for allowing positioning of the vibration attenuator without impeding the passing of electron beams through the plurality of pores.

10. The shadow mask assembly according to claim 9, wherein the reference portions are holes in the shadow mask.

11. The shadow mask assembly according to claim 10, wherein the holes differ in shape from the pores.

12. The shadow mask assembly according to claim 10, wherein the holes differ in size from the pores.

13. The shadow mask assembly according to claim 9, wherein the reference portions are formed in a non-effective area of the shadow mask.

14. The shadow mask assembly according to claim 9, wherein the reference portions are formed in an effective area of the shadow mask.

* * * * *